United States Patent [19]

Salerno

[11] Patent Number: 4,944,713

[45] Date of Patent: Jul. 31, 1990

[54] TREADMILL SPEED RESET SYSTEM

[76] Inventor: Mark Salerno, 205 E. Main St., Suite 3-6, Huntington, N.Y. 11743-2923

[21] Appl. No.: 428,588

[22] Filed: Oct. 30, 1989

[51] Int. Cl.[5] ..... F16H 55/52; A63B 23/06

[52] U.S. Cl. ..... 474/11; 474/8; 474/70; 198/330; 272/69

[58] Field of Search ..... 474/8, 11, 12, 17, 18, 474/37, 39, 69, 70, 73, 74, 76; 198/323, 330, 331, 834, 835; 272/69

[56] References Cited

U.S. PATENT DOCUMENTS

| | | | |
|---|---|---|---|
| 2,969,768 | 1/1931 | Grant | 272/69 |
| 3,737,163 | 6/1973 | Sumrall | 272/69 |
| 3,811,331 | 5/1974 | Moogk | 474/19 |
| 4,088,036 | 5/1978 | Hillman | 474/12 |
| 4,174,641 | 11/1979 | Hillman | 474/12 |
| 4,541,821 | 9/1985 | Sakakibara | 474/17 |
| 4,635,928 | 1/1987 | Ogden et al. | 272/69 |
| 4,748,394 | 5/1988 | Watanabe | 198/330 X |
| 4,749,181 | 6/1988 | Pittaway et al. | 272/69 |
| 4,792,134 | 12/1988 | Chen | 272/69 |

*Primary Examiner*—Thuy M. Bui
*Assistant Examiner*—Ezio Di Sante
*Attorney, Agent, or Firm*—Leonard Belkin

[57] ABSTRACT

A treadmill having a walking belt with a constant speed drive motor and a transmission for adjusting the speed of the walking belt. The transmission employs input and output variable pitch pulleys to effect the belt speed change. The pulleys employ adjustably spaced sheaves to accomplish the change in speed ratio. The input pulley sheaves are adjusted by a speed change motor while the output pulley sheaves employ internal springs to adjust the sheave separation to the main drive belt joining the two pulleys. A speed reset motor is employed to keep the output pulley rotating while the sheave separation in the input pulley is adjusted for minimum walking belt speed after the main drive motor is shut down to insure that the main drive belt adjusts properly on the output pulley.

18 Claims, 4 Drawing Sheets

TREADMILL SPEED RESET SYSTEM

BACKGROUND OF THE INVENTION

The present invention relates to a drive system for treadmills and more particularly to variable pitch belt drive transmissions to control the speed of the walking belt.

A treadmill is a motorized device that is used for exercise. By adjusting the speed of the walking belt, exercise can be performed at any desired level.

In one type of treadmill currently in use, the walking belt is driven by a synchronous AC drive motor which runs at a constant speed. To adjust the speed of the walking belt, the motor is connected to the walking belt through a variable transmission.

A typical variable transmission in use for such an application consists of two sets of adjustable sheave pulleys. The input pulley is connected to the shaft of the drive motor while the output pulley is connected to the walking belt. A main drive V-belt connects the two pulleys together.

The input pulley sheaves are conically shaped and the distance between the sheaves, which is adjusted by a speed adjust motor, determines the effective diameter of the pulley. The output pulley sheaves are similarly conically shaped and are forced together by internal springs. The main drive V-belt, which is of fixed length, adjusts the separation of the output pulley sheaves determined by how much of the belt is required by the input pulley (i.e., its effective diameter).

To decrease the speed of the walking belt, the input pulley sheaves are moved further apart by the speed adjust motor allowing the springs in the output pulley to drive the sheaves closer together, the effective diameter of the input pulley going down and the effective diameter of the output pulley increasing, thereby changing the input to output drive ratio of the transmission resulting in a slow down of the walking belt.

In order to adjust the input to output drive ratio of the transmission, the system must be moving to allow the main drive belt to be properly tensioned between the input and output pulleys. Attempting to adjust the transmission without the system moving, would cause either binding of the main drive belt between the input pulley sheaves when the input pulley sheaves are forced together or the total disengagement of the main drive belt from the input pulley when the sheaves are adjusted apart.

The user of the treadmill is instructed to bring the walking belt down to its slowest speed before turning the apparatus off so that the walking belt will start up at the slowest speed when the next user starts to use the machine. If the current user forgets to slow the walking belt down first, which is not an uncommon occurrence, then for the reasons noted above, it is not possible to get the machine at the slowest speed prior to its next use. Even when the machine is started at the slowest speed, the next user could incur a jolt or jerk when he or she starts the machine while standing on the walking belt with some injury possible if the transmission is left at high speed.

Thus, utilizing the speed reset motor to adjust the separation of the input pulley sheaves after the treadmill has been shut down will not cure the problem.

A number of United States patents show treadmill drive and belt drive transmission systems utilizing sheave separation to vary the output drive speed. They include U.S. Pat. Nos. 3,731,549, 4,088,036, 4,174,641, and 4,541,821. None of these patents shows a treadmill drive system utilizing adjustable input and output sheave separation for the control of the walking belt incorporating the principles of this invention.

SUMMARY OF THE INVENTION

In this invention, the problems described above are overcome or minimized by providing for continued rotation of the output pulley after the treadmill is shut down while sheave separation on the input pulley is increased to maximum value for slowing down the walking belt.

In accordance with a preferred embodiment of this invention, there is added a speed reset motor to rotate through a one way clutch the output pulley. At the same time, the speed adjust motor is separating the input sheaves for minimum speed after the treadmill is shut down, thus permitting the drive belt to properly adjust on the spring loaded output pulley. When the input pulley sheaves reach maximum separation, an end switch is tripped to stop both the speed change and speed reset motors. This end switch can also be connected to the main drive motor to keep it from starting until the system is fully reset.

One of the advantages of this invention is that the system can be adjusted for a smooth, soft startup, accelerating up to the minimum speed, eliminating any sharp movements of the walking belt with every start.

It is thus a principal object of this invention to provide a variable ratio belt drive system for treadmills having improved operating characteristics.

Other objects and advantages of this invention will hereinafter become obvious from the following description of preferred embodiments of this invention.

DESCRIPTION OF THE PREFERRED EMBODIMENTS

Figure 1A:
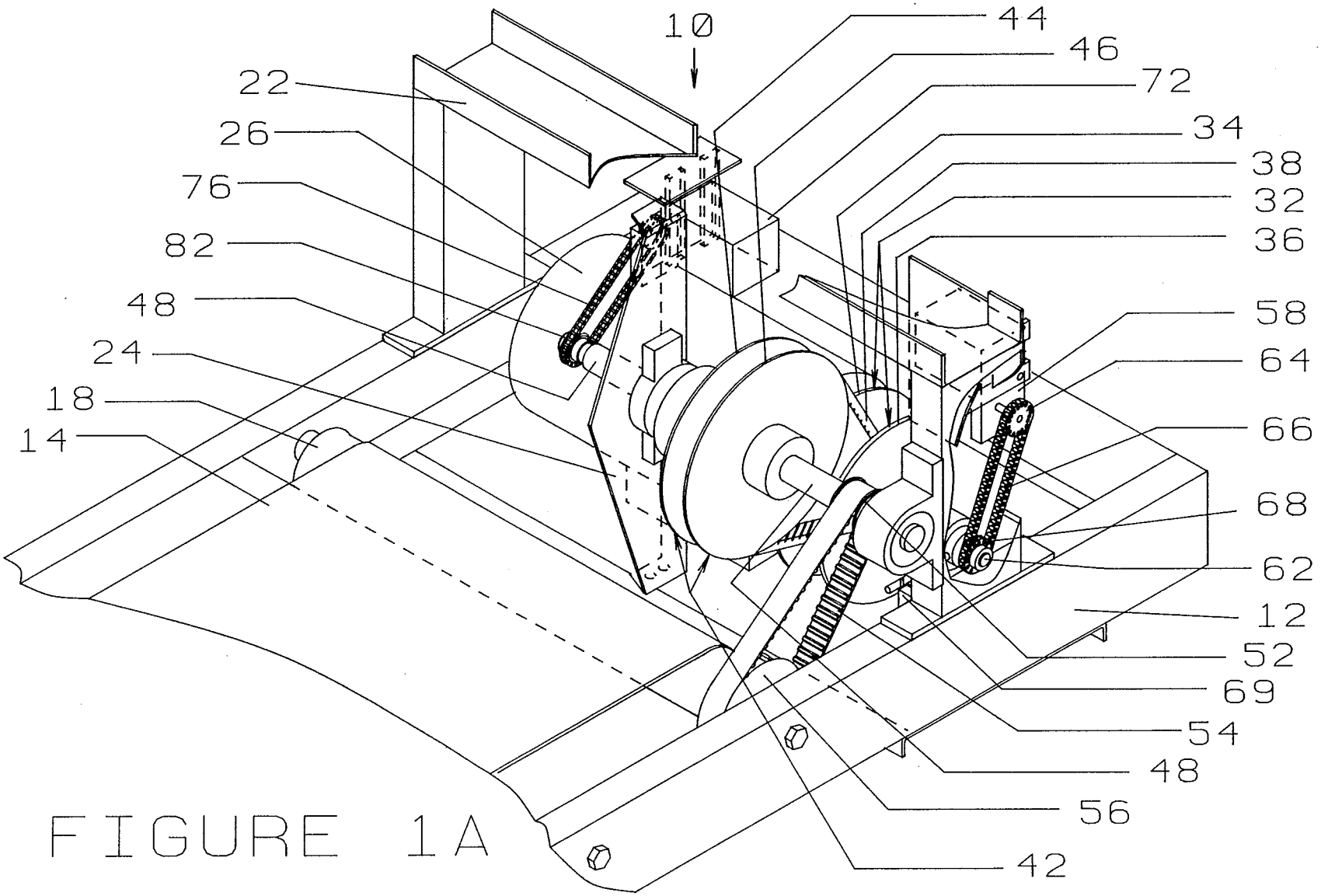
FIG. 1A is an isometric view partially cut away of the front portion of a preferred embodiment of the invention.
Figures 1B, 2:
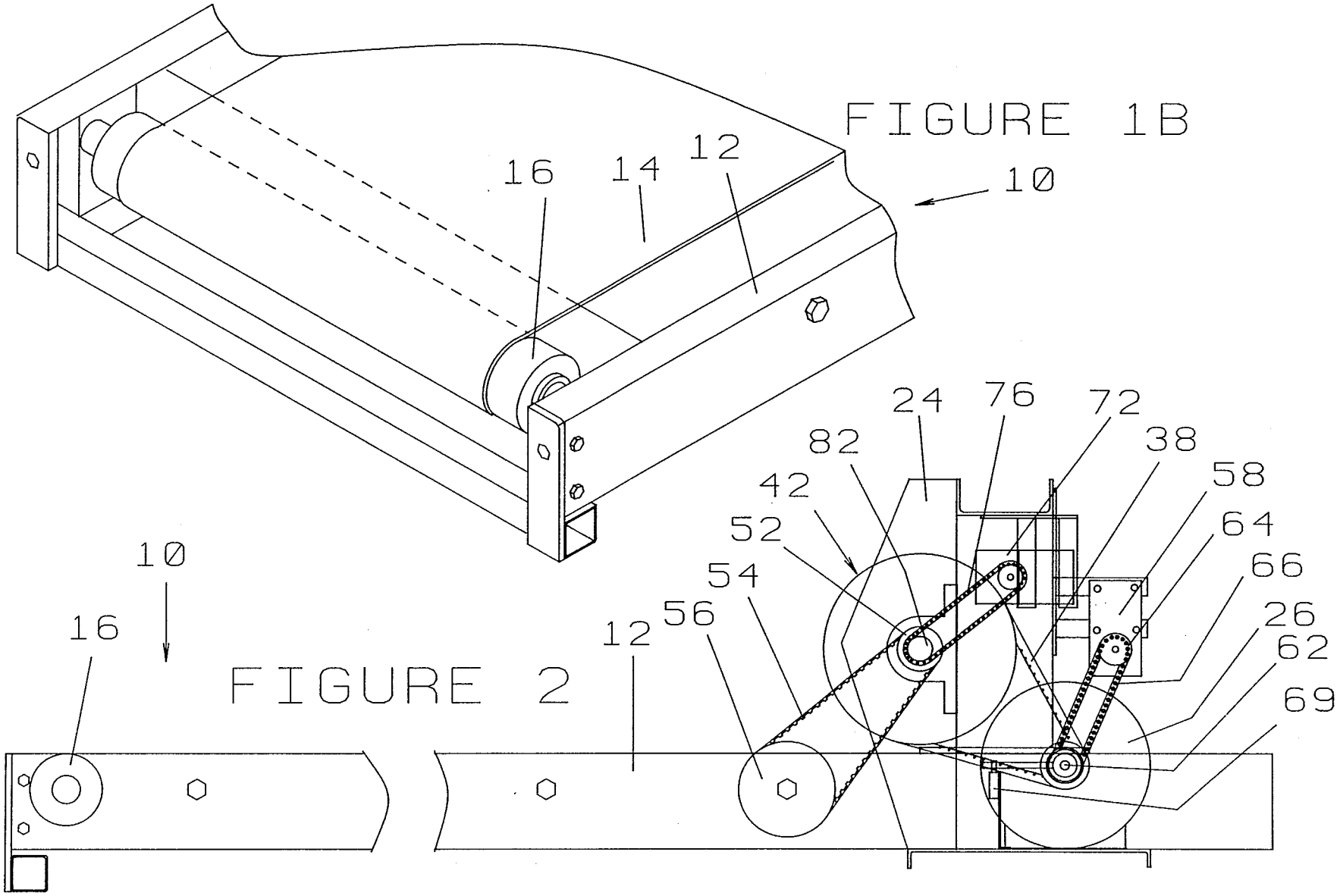
FIG. 1B is an isometric view of the foot portion of the embodiment shown in FIG. 1A.
FIG. 2 is a side elevation view of the embodiment shown in FIG. 1.

Referring to FIGS. 1A, 1B, 2 and 3, there is shown a treadmill 10 consisting of a box-like frame 12 containing an endless walking belt 14 mounted for rotation on an idler roller 16 at the foot of treadmill 10 and front drive roller 18 which drives walking belt 14.

Supported by frame 12 adjacent the front end of treadmill 10 are an inverted U-shaped structure 22 and a vertically extending plate 24 for supporting the drive and transmission system for front drive roller 18.

Main drive motor 26 drives roller 18 through a variable drive ratio transmission which is described as follows. Motor 26 is connected through a main drive motor shaft 28 to input pulley 32 consisting of a pair of sheaves 34 and 36 whose separation is adjustable as will be described later. A V-shaped main drive belt 38 connects input pulley 32 to output pulley 42 which is made up of a pair of sheaves 44 and 46 whose separation is adjustable in a manner to be described later.

Output pulley 42 transfers the drive to front drive roller 18 through a jack shaft 48, pulley 52, belt 54, and pulley 56 in the manner illustrated.

To adjust the separation between sheaves 34 and 36 of input pulley 32, there is provided a speed change motor 58 which adjusts the rotational position of speed change lead screw 62 through a chain sprocket 64, a chain 66, and a driven lead screw sprocket 68. The rotation of lead screw 62 changes the separation of sheaves 34 and 36 in a manner which is conventional and such units are commercially available and the details of such an arrangement do not form a part of this invention. An end switch 69 shuts off motor 58 when sheave separation in input pulley 32 reaches minimum or maximum value.

Output pulley 42 consisting of sheaves 44 and 46 is also a conventional and commercially available component in which internal springs 70 force together sheaves 44 and 46. Since main drive belt 38 is of fixed length, when the separation of sheaves 34 and 36 on input pulley 32 is changed, main drive belt 38 will adjust the separation of sheaves 44 and 46 of output pulley 42. For example, when sheave separation in input pulley 32 decreases thereby increasing the diameter of main drive belt 38 around input pulley 32, main drive belt 38 forces increased sheave separation in output pulley 42 to compensate, decreasing its diameter around that pulley, altering the drive ratio of the transmission.

Input pulley 32 and output pulley 42 each being adjustable to alter its effective diameter and hence the diameter of the belt mounted thereon to alter the drive ratio is referred to herein as being variable pitch pulleys.

In the normal operation of treadmill 10, main drive motor 26 is driving walking belt 14 at some particular rate of speed. When it is desired to increase the speed of walking belt 14, speed change motor 58 is energized to turn the speed change lead screw 62 in the direction of forcing input pulley sheaves 34 and 36 closer together. As they move closer together, main drive belt 38 forces spring loaded output pulley sheaves 44 and 46 further apart. This changes the input to output drive ratio and causes an increase in the speed of jack shaft 48 which translates to walking belt 14.

Causing speed change lead screw 62 to rotate in the opposite direction will result in walking belt 14 slowing down.

When the user turns off treadmill 10, the transmission is sometimes left adjusted to a high speed even though instructions call for the user to bring the walking belt speed to a minimum value before the unit is turned off. This situation could pose a problem for the next user if he or she stands on walking belt 14 when the unit is started and walking belt 14 begins its motion at a high speed or with a rapid jolt. Adjusting the transmission to minimum belt speed while main drive belt 38 is not moving is not effective to eliminate the jerky start because main drive belt 38 will not adjust properly on output pulley 42 containing the internal springs.

In order to eliminate this problem and obtain additional advantages to be described below, treadmill 10 is provided with a speed reset motor 72 to drive output pulley 42 through jack shaft 48, a chain 76, and an overriding clutch 82 which permits drive only in one direction, from speed reset motor 72 to output pulley 42.

The purpose of clutch 82 is to prevent output pulley 42 from driving speed reset motor 72.

Figure 3:
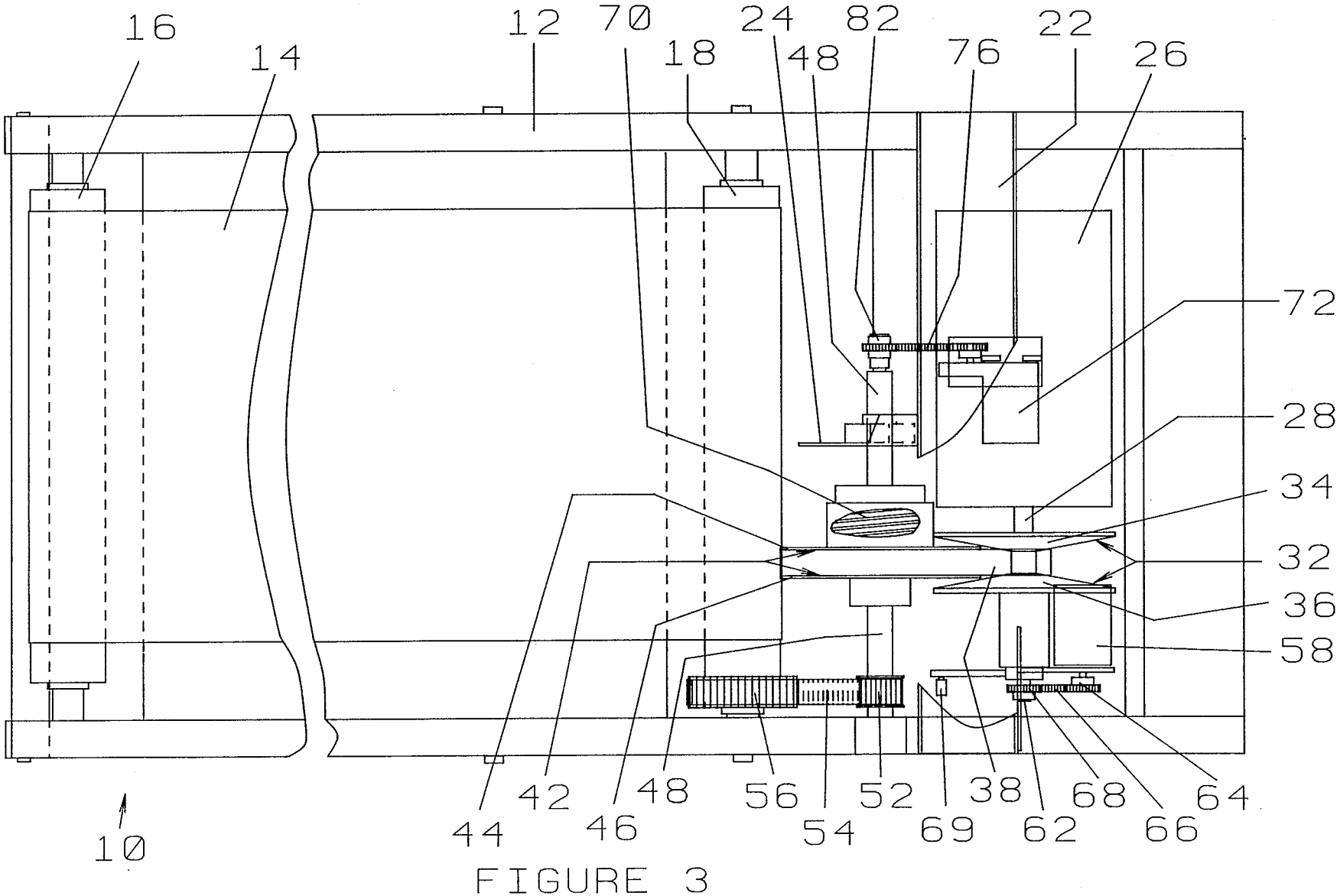
FIG. 3 is a plan view of the preferred embodiment.
Figure 4:
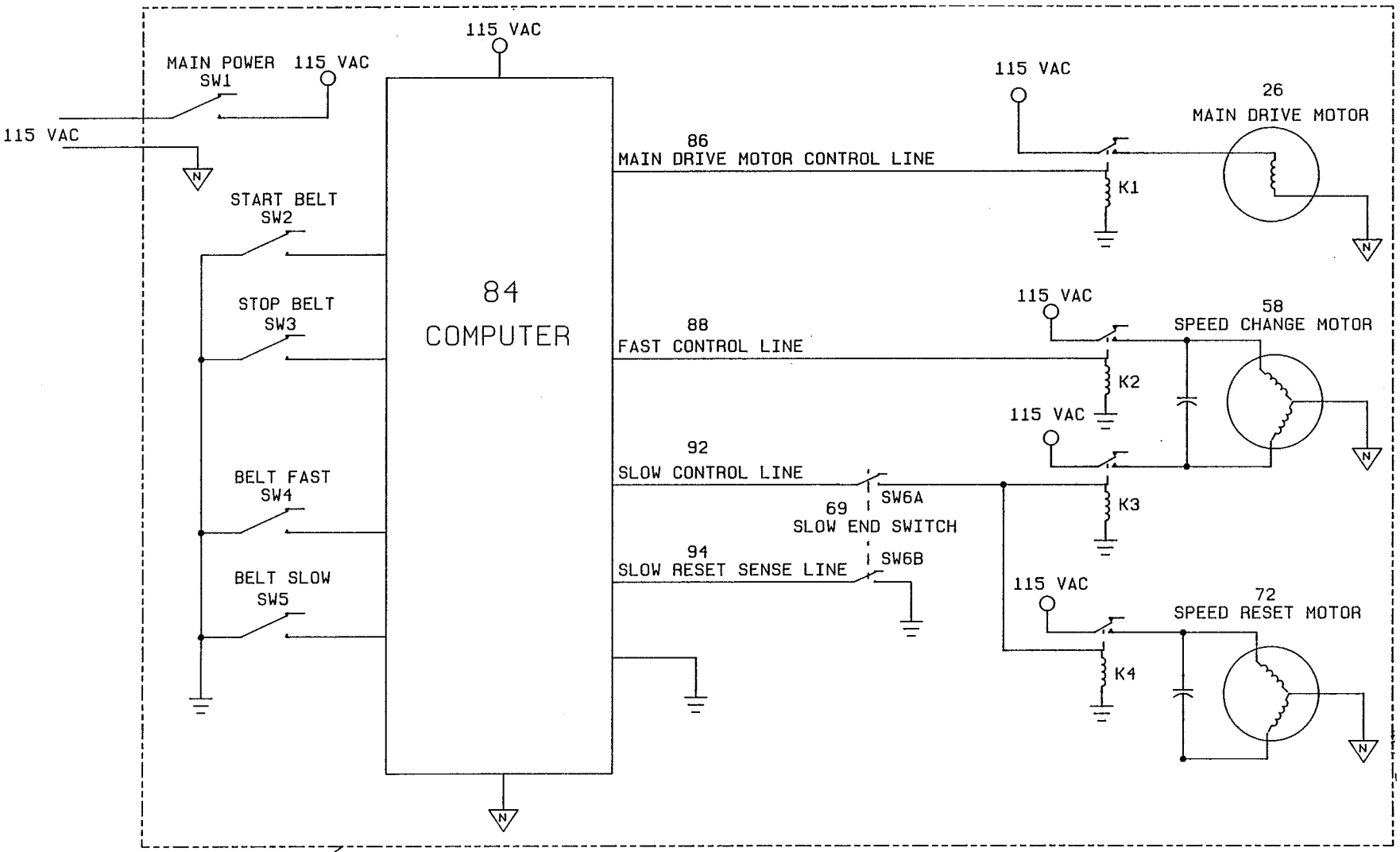
FIG. 4 is a schematic showing the operational relationship between the main drive motor, the speed reset motor, and the speed change motor.

FIG. 4 shows schematically the details of system 83 to control the operation of treadmill 10. A main power switch SW1 provides power to system 83. A computer 84 which typically would comprise a single chip effects the operation of main drive motor 26, speed change motor 58, and speed reset motor 72 through lines 86, 88, 92 and 94, and relays K1, K2, K3 and K4, respectively. A pair of ganged slow end switches SW6A and SW6B comprising end switch 69 shown in FIG. 3 are in control lines 92 and 94, respectively, as shown.

Manually operated button switches SW2, SW3, SW4, and SW5 are connected to computer 84 for the following purposes. Switch SW2 when closed causes main drive motor 26 to turn on and start to drive walking belt 14. Switch SW3 when closed directs computer 84 to stop walking belt 14 by deenergizing main drive motor 26. Switch SW4 when depressed causes computer 84 to speed up belt 14 and switch SW5 when depressed causes walking belt 14 to slow down.

Computer 84 is programmed so that control system 83 operates in the following manner:

When main power switch SW1 is closed computer 84 energizes slow control line 92. When sheaves 32 and 34 are not in the maximum open position end switch 69 allows slow end switches SW6A and SW6B to close. This allows slow control line 92 to energize relay K3 which energizes speed change motor 58 in the direction that begins to open sheaves 32 and 34. At the same time relay K4 is energized which energizes speed reset motor 72. This causes jack shaft 48 to rotate output pulley 42 at a very slow speed permitting main drive belt 38 to adjust properly on spring loaded sheaves 44 and 46 of output drive pulley 42. The slow rotation of jack shaft 48 also drives the walking belt 14 at a very slow rate.

When sheaves 34 and 36 separate to maximum, end switch 69 will cause switch SW6A to deenergize both relays K3 and K4 causing speed change motor 58 and speed reset motor 72 to stop. When switch SW6B is opened, computer 84 senses the system is set to the speed reset position by the slow reset sense line 94. Computer 84 will prevent the main drive motor 26 from energizing until switch SW6B opens.

The separation of sheaves 32 and 34 in the fully open position as set by switches SW6A and SW6B is such that main drive belt 38 is loosely held. This allows the transmission to exhibit a zero speed or soft start to the walking belt when main drive motor 26 is engaged.

Walking belt 14 is made operational by energizing start walking belt switch SW2. Computer 84 first checks that switch SW6B is in the speed reset open position. Computer 84 then energizes the main drive motor control line 86 which then energizes relay K1 to energize main drive motor 26. This starts walking belt 14 with a soft start and computer 84 then adjusts the transmission to the slowest speed that will not allow main drive belt 38 to slip. The operator may then adjust the speed of the walking belt 14 faster by energizing belt fast switch SW4. Computer 84 then energizes relay K2 which energizes speed change motor 58 in the direction which causes the variable pitch pulley system to speed up which translates to the speed up of walking belt 14.

The operator may then adjust the speed of walking belt 14 slower by depressing belt slow switch SW5. Computer 84 then energizes the slow control line 92 which energizes relay K3 which then energizes speed change motor 58 in the direction which causes the variable pitch pulley system to slow down which translates to the slow down of walking belt 14. At the same time relay K4 is also energized which turns on speed reset motor 72. Since shaft 48 is turning much faster than chain 76, overrunning clutch 82 is disengaged. The speed reset motor 72 is always turned on with the speed change motor 58 to simplify the drive circuit.

The operator may then stop walking belt 14 by depressing belt stop switch SW3. Computer 84 then deenergizes main drive motor control line 86 which deenergizes relay K1 which stops walking belt 14. Computer 84 then automatically energizes slow control line 92 which energizes relays K3 and K4 and speed change motor 58 and speed reset motor 72. This cause the variable pitch pulley system to adjust to the speed reset position. When sheaves 34 and 36 are fully separated, switch SW6B also opens causing slow reset sense line 94 to inform computer 84 that the variable pitch pulley system is in the speed reset position. Computer 84 is programmed not to allow the main drive motor 26 to start until the variable pitch pulley system is set to speed reset position. This will insure the next user will not start the belt at a high speed or the belt will not jolt or present any hazard to the user. It also allows walking belt 14 to present a soft start at every start up of the walking belt 14.

The preferred embodiment of this invention was constructed and operated successfully in accordance with the principles of this invention. Computer 84 comprised a single integrated chip, Intel 8051, which was programmed to carry out the operation of control system 83.

In the preferred embodiment described above, it is seen that a treadmill embodying the principles of this invention is safer to use than treadmills of this design now in use and at the same time requires less maintenance and suffers less down time due to any malfunction in the operation of the main drive belt.

While only a certain preferred embodiment of this invention has been described, it is understood that many variations of this invention are possible without departing from the principles of this invention as defined in the claims which follow.

What is claimed is:

1. A treadmill comprising in combination:

a. frame means for supporting an endless walking belt for movement;

b. a main drive motor;

c. variable speed transmission means for receiving drive input from said main drive motor and for delivering its drive output to move and adjust the speed of said walking belt;

d. said transmission means comprising variable pitch input pulley means for receiving shaft input from said main drive motor, variable pitch output pulley means for delivering shaft power to said walking belt, main drive belt means for transferring drive from said input pulley means to said output pulley means, and speed change means for varying the effective pitch of said input pulley means for altering the speed of said walking belt, said output pulley means including means affected by said main drive belt means to make a change in the effective diameter of said output pulley means;

e. programmed means in response to deenergization of said main drive motor to automatically energize said speed change means to change the effective diameter of said input pulley means to reset the transmission means to minimum walking belt speed; and f. programmed speed reset means to continue rotation of said output pulley means to permit said output pulley means after said main drive motor is deenergized and while said speed change means is slowing down said walking belt to be adjusted properly by said main drive belt means while the effective diameter of said input pulley means is being changed.

2. The treadmill of claim 1 in which each of said input and output pulley means comprises a pair of sheaves whose separation is adjustable, the effective diameter of each said pulley means being determined by the separation of the sheaves therein.

3. The treadmill of claim 2 in which said main drive belt means comprises a belt to mate with said sheaves.

4. The treadmill of claim 3 wherein said speed change means adjusts the separation of the sheaves in said input pulley means.

5. The treadmill of claim 4 wherein said belt is of fixed length and adjusts the separation of the sheaves in said output pulley means as a result of changes in the effective diameter of said input pulley means.

6. The treadmill of claim 5 including end switch means to disable said speed change means when the separation of said sheaves in said input pulley means corresponds to a preselected maximum and minimum separation of the sheaves in said input pulley means.

7. The treadmill of claim 6 in which increased separation of said sheaves in said input pulley means produces a slow down in walking belt speed.

8. The treadmill of claim 7 in which maximum separation of the sheaves in said input pulley means produced by said means to energize said speed change means after said main drive motor is deenergized is sufficient to cause said main drive belt to be loosely held thereby to insure a zero speed start of said walking belt when said main drive motor is energized.

9. The treadmill of claim 6 including means to disable said speed reset means when said speed change means is disabled.

10. The treadmill of claim 1 wherein said speed reset means drives said output pulley means through one way clutch means to prevent said output pulley means from driving said speed reset means.

11. The treadmill of claim 1 wherein said main drive motor operates at a constant speed.

12. A treadmill comprising in combination:

a. frame means for supporting an endless walking belt;

b. a constant speed main drive motor;

c. variable speed transmission means for receiving drive input from said main drive motor and for delivering its drive output to move and adjust the speed of said walking belt;

d. said variable speed transmission means comprising variable diameter input pulley means to receive shaft input from said main drive motor, self-adjusting variable diameter output pulley means for delivering shaft power to said walking belt, and fixed length belt means interconnecting said pulley means;

e. speed change means to adjust the diameter of said input pulley to change the speed ratio of said transmission means; and f. programmed means in response to deenergization of said main drive motor to automatically (i) energize said speed change means to decrease the diameter of said input pulley means to reset the transmission means to reduced walking belt speed and (ii) maintain rotation of said output pulley means while said fixed length belt means adjusts said variable diameter output pulley means.

13. The treadmill of claim 12 having end switch means to automatically deenergize said speed change means and terminate rotation of said output pulley means when the diameter of said input pulley means is at a preselected minimum or maximum value.

14. The method of operating a treadmill having frame means for supporting an endless walk belt for movement, a main drive motor, and a variable speed transmission means comprising a variable effective diameter input pulley means for receiving shaft input from said main drive motor, variable effective diameter output pulley means for delivering shaft output, main drive belt means for transferring drive from said input pulley means to said output pulley means, to drive said walking belt, and programmed speed change means for varying the effective diameter of said input pulley means for altering the speed of said walking belt, the effective diameter of said output pulley means being adjusted by said main drive belt means, comprising the steps of automatically energizing said speed change means when said main drive motor is deenergized at a time when the speed of said walking belt is greater than a selected minimum speed to change the diameter of said input pulley means in the direction of slowing down said walking belt, and automatically driving said output pulley means while said speed change means is energized and said main motor is deenergized to insure proper adjustment of said main drive belt means on said output pulley means.

15. The method of claim 14 wherein said speed change means is automatically deenergized when an output ratio of said transmission means corresponding to said selected minimum speed of said walking belt is reached.

16. The method of claim 15 wherein driving of said output pulley means is automatically terminated when said speed change means is deenergized.

17. The method of claim 16 wherein each of said input and output pulley means comprises a pair of sheaves whose separation is adjustable, the effective diameter of each said pulley means being determined by the separation of the sheaves therein, said speed change means adjusting the separation of the sheaves in said input pulley means.

18. The method of claim 17 wherein the maximum separation of said sheaves in said input pulley means is such as to cause said main drive belt means to be loosely held on said pulley means to insure a zero speed start of said walking belt when said main drive motor is energized.

* * * * *